United States Patent [19]

Harada et al.

[11] 4,169,998

[45] Oct. 2, 1979

[54] IRON CORE ASSEMBLY FOR MAGNETIZING COLUMNAR PERMANENT MAGNETS FOR USE IN ELECTROSTATIC DEVELOPING APPARATUS

[75] Inventors: Hideki Harada, Urawa; Keitaro Yamashita, Kamisatomachi; Katsunobu Yamamoto, Kumagaya, all of Japan

[73] Assignee: Hitachi Metals, Ltd., Japan

[21] Appl. No.: 838,870

[22] Filed: Oct. 3, 1977

[51] Int. Cl.[2] ..... H01F 13/00

[52] U.S. Cl. ..... 335/284; 118/658; 361/143

[58] Field of Search ..... 335/284; 361/143; 118/658; 29/607

[56] References Cited

U.S. PATENT DOCUMENTS

| | | | |
|---|---|---|---|
| 3,158,797 | 11/1964 | Andrews | 335/284 |
| 3,402,698 | 5/1967 | Kojima et al. | 118/658 |
| 3,455,276 | 5/1967 | Anderson | 118/658 |
| 3,828,730 | 5/1972 | Yamashita et al. | 118/658 |
| 3,952,701 | 11/1974 | Yamashita et al. | 118/658 |

FOREIGN PATENT DOCUMENTS

| | | | |
|---|---|---|---|
| 5114800 | 7/1974 | Japan | 335/284 |

*Primary Examiner*—R. N. Envall, Jr.

*Attorney, Agent, or Firm*—Craig and Antonelli

[57] ABSTRACT

Disclosed is an iron core assembly for magnetizing columnar permanent magnet, particularly columnar ceramic permanent magnets adapted for use in magnetic-brush type electrostatic developing apparatus. The invention is to clarify the magnetic pattern most effective for the development, as well as a construction for presenting such a pattern, and is aiming to provide a magnetizing iron core assembly having an improved construction of magnetic poles and magnetizing coil windings.

4 Claims, 5 Drawing Figures

IRON CORE ASSEMBLY FOR MAGNETIZING COLUMNAR PERMANENT MAGNETS FOR USE IN ELECTROSTATIC DEVELOPING APPARATUS

LIST OF PRIOR ART REFERENCES (37 CFR 1.56 (a))

The following references are cited to show the state of the art:

Japanese Utility Model Laid-Open No. Sho. 51-14800 Keitarou Yamashita et al July 22, 1974

U.S. Pat. No. 3,455,276 Glenn R. Anderson May 23, 1967

U.S. Pat. No. 3,402,698 Motoki Kojima et al May 26, 1967

U.S. Pat. No. 3,828,730 Keitarou Yamashita et al May 16, 1972

U.S. Pat. No. 3,952,701 Keitarou Yamashita et al Nov. 5, 1974

BACKGROUND OF THE INVENTION

The present invention relates to an iron core assembly for magnetizing permanent magnets for use in magnetic-brush type electrostatic developing apparatus and, more particularly, to an iron core assembly for imparting a plurality of axially extending magnetic poles on the cylindrical surface of a columnar magnet which is generally referred to as "magnetic roll."

Developers conventionally used in electrostatic developing apparatus for visualizing an electrostatic latent image are divided into two types of bicomponent developer consisting of a magnetic carrier and toner particles, and monocomponent developer having magnetic particles contained by toner particles.

Also, there have been two ways of developing latent image by these developers: cascade type method and magnetic-brush type method. In the past, the cascade type method had been commonly used. However, recently, the magnetic-brush type method has been getting popular, because of the so-called edge effect which causes an insufficient development at the central portion of the region to be developed and other drawbacks inherent in the cascade type method.

In the magnetic-brush type developing apparatus, developer particles are conveyed to a zone close to a latent image held on an electrostatic image carrier, in accordance with a rotation of developing roll. A brush-shaped protrusion is a formation of the developer particles on the surface of the developing roll, due to the magnetic force of a permanent magnet incorporated in the developing roll. The developer particles are transferred to the electrostatic latent image to visualize the latter, as the image is rubbed by the brush-like protrusion of the developer particles, in accordance with the rotation of the developing roll or the movement of the latent image itself.

There have been proposed a variety of types of permanent magnets for the developing rolls of the kind described.

For example, the specification of U.S. Pat. No. 3,455,276 (Anderson) discloses a columnar permanent magnet consisting of a plurality of previously magnetized sector-shaped rubber permanent magnets adhered to the cylindrical surface of a rotary shaft, while the specification of U.S. Pat. No. 3,402,698 of Kojima et al discloses a developing roll constituted by block-shaped permanent magnets.

Also, it has been acknowledged that the permanent magnet for use in the developing roll is most advantageously made of unitarily formed ceramic permanent magnets. It will be seen that a uniform magnetic flux distribution is obtained along the entire length of an axially extending unitary ceramic permanent magnet, because there is no discontinuity of magnet pieces on the magnetic poles. Specifications of U.S. Pat. Nos. 3,828,730 and 3,952,701 of Yamashita et al exemplarily discloses developing rolls making use of the unitary ceramic permanent magnet.

It is quite difficult to magnetize the unitary ceramic permanent magnet piece. Only Japanese Utility Model Laid-open Publication No. 14800/1976 (Published on Feb. 3, 1976) teaches a broad concept of such a magnetization. However, even this Publication fails to disclose a concrete method of magnetization. Thus, practical magnetizing means for imparting a complicated magnetic pattern to a columnar magnet have not been proposed up to now.

It is therefore an object of the invention to provide magnetizing means capable of imparting an extremely strong attracting force to a developing roll.

More specifically, the invention aims to provide magnetizing means capable of magnetizing a columnar permanent magnet material in such a manner that the magnetized columnar permanent magnet exhibits a rectangular-wave-like pattern of magnetic flux density distribution along the circumference thereof, so that the magnetic flux density may abruptly increase and decrease over the circumference of the magnet, thereby to exert a large attracting force on the magnetic developer particles.

To this end, according to the invention, there is provided an iron core assembly for magnetizing a columnar permanent magnet for use in an electrostatic developing apparatus, comprising:

a plurality of axially extending and circumferentially disposed magnetic poles defining at their radially inner ends a through-bore for receiving a columnar permanent material to be magnetized, said inner ends being adapted to be located in the close proximity of the outer cylindrical surface of said columnar permanent magnet material received by said through-bore, and coil windings for magnetizing said magnetic poles, said coil windings being wound around said magnetic poles and received by grooves formed between adjacent magnetic poles, wherein the circumferential width of said magnetic pole is greater than that of said groove.

The above and other objects, as well as advantageous features of the invention will be understood from the following description of the preferred embodiments taken in conjunction with the attached drawings.

DETAILED DESCRIPTION OF PREFERRED EMBODIMENTS

Figure 1:
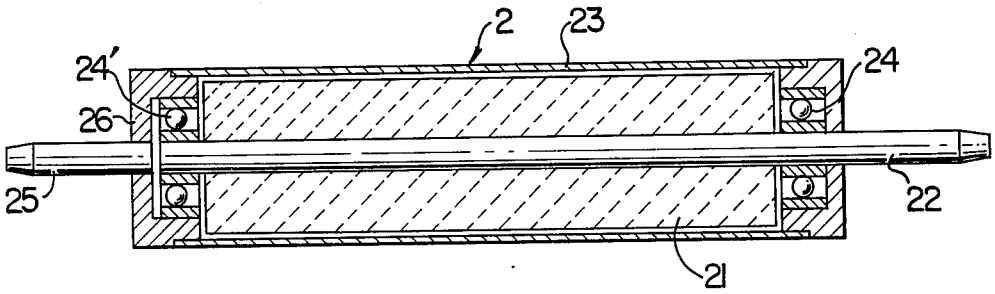
FIG. 1 is a longitudinal-sectional view of a developing roll incorporating a columnar permanent magnet which has been magnetized by means of an iron core assembly in accordance with the invention.
Figure 2:
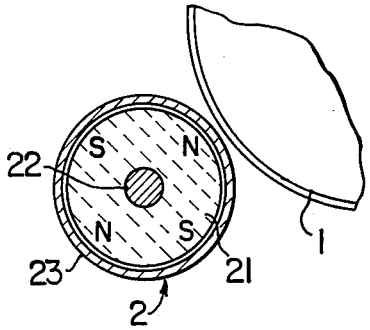
FIG. 2 is a cross-sectional view of essential parts of an electrostatic developing apparatus having a developing roll incorporating a columnar permanent magnet which has been magnetized by means of the iron core assembly according to the invention.
Figure 3:
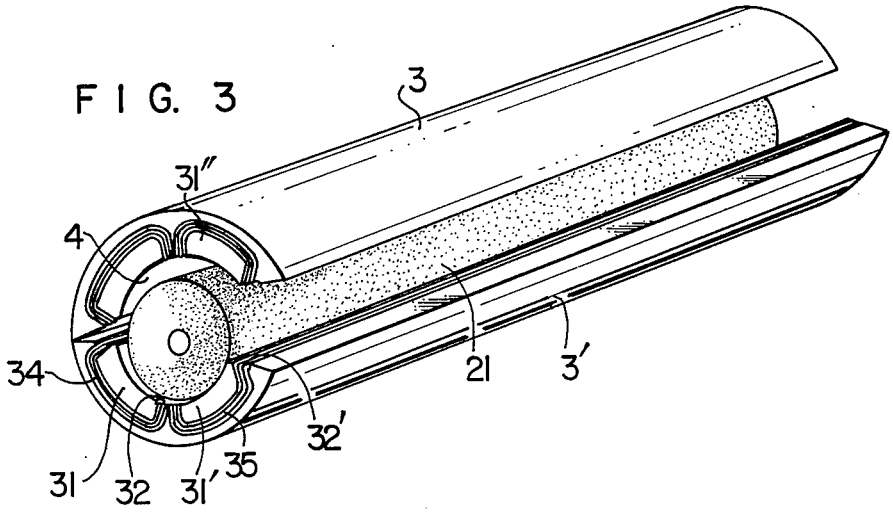
FIG. 3 is a perspective view of an iron core assembly embodying the present invention.

Referring at first to FIGS. 1 thru 3, an electrostatic developing apparatus is shown, comprising a photosensitive body 1 carrying an electrostatic latent image, and a developing roll opposing to the photosensitive body in a juxtaposed relation. The developing roll 2 houses a columnar ceramic permanent magnet 21 fixed to a rotary shaft 22. A cylindrical shell 23 made of a nonmagnetic material such as a plastic or aluminum is disposed to surround the permanent magnet 21, and is supported by the rotary shaft 22 through bearings 24, 24'. The shell 23 is connected to another rotary shaft 25, through a side plate 26.

The arrangement is such that the permanent magnet 21 is locked against rotation when the rotary shaft 22 is kept stationary, while the cylindrical shell 23 is allowed to rotate along with the another rotary shaft 25. Alternatively, the arrangement may be such that the permanent magnet 21 is rotated, while the cylindrical shell 23 is kept stationary.

According to the present invention axially extending magnetic poles on the cylindrical surface of the columnar permanent magnet 21 can effectively be formed by means of an iron core assembly as shown in FIG. 3.

The iron core assembly is split along a plane passing through the longitudinal axis into complementary iron core segments 3, 3' which define, when coupled with each other, a through-bore 4 having such a diameter as to just receive the columnar magnet material to be magnetized.

The inner peripheral wall of the iron core segments have a plurality of projections 31, 31', 31'' . . . , form magnetic poles of the magnetizing yoke. Grooves 32, 32' defined between adjacent magnet poles, for example, the poles 31, 31', receive magnetizing coil windings 34, 35.

It will be seen from FIG. 3 that magnetic poles 31, 31', 31'' having a relatively large circumferential width are separated by grooves 32, 32' of a relatively small circumferential width. The circumferential width of the magnetic pole is preferably 3.5 to 10 times that of the groove.

Figure 5:
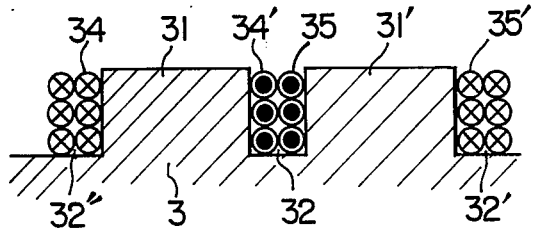
FIG. 5 is an enlarged sectional view of an essential part of the iron core assembly of FIG. 3.

Linearly exploded magnetic poles are shown in a larger scale in FIG. 5.

By way of example, a columnar permanent magnet material of 28 mm dia. was magnetized to become a permanent magnet having four magnetic poles. The circumferential width and the depth of the grooves 32, 32', 32'' were selected to be 4 mm and 6 mm, respectively. The coil windings 34, 35 were supplied with magnetizing currents to produce magnetic field intensities of 400 to 500 KAT/m, respectively.

Figure 4:
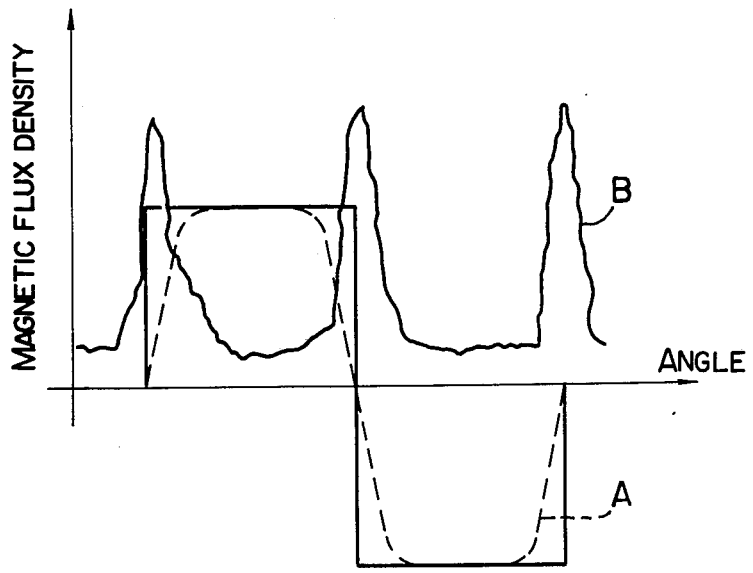
FIG. 4 is an illustration showing the manner of distribution of magnetic flux.

Consequently, a magnetic flux density distribution as shown by curve A of FIG. 4 was obtained along the circumference of the columnar permanent magnet. Then, the magnetic attracting force, shown by curve B in FIG. 4 was measured along the circumference of the magnet, making use of a small ferromagnetic ball. As will be seen from curve B of FIG. 4, an extremely large magnetic attracting force was obtained at each pole changing point.

The grooves 32, 32', 32'' are preferably fully filled with the coil windings 34, 35. These coil windings may have different ampere-turns or may have equal ampere-turns. In the latter case, since the developing poles formed on the permanent magnet can produce an equal attracting force, the columnar permanent magnet can be used in a developing apparatus in which the magnet is rotated and the cylindrical shell is kept stationary.

Having described the invention through a specific preferred embodiment, it is to be noted here that various changes and modifications may be imparted thereto without departing from the spirit and scope of the invention which is defined solely by the appended claims.

What is claimed is:

1. An iron core assembly for magnetizing a columnar permanent magnet for use in an electrostatic developing apparatus comprising:

a plurality of axially extending and circumferentially spaced magnetizable projections defining, at their radially inner ends, a throughbore for receiving a columnar permanent magnet to be magnetized, said inner ends being located in close proximity to the outer cylindrical surface of said columnar permanent magnet received by said throughbore, coil windings for magnetizing said magnetizable projections so as to provide circumferentially alternate magnetic poles, said coil windings being wound around said magnetizable projections and received by grooves formed between adjacent magnetizable projections, and wherein the circumferential width of said magnetizable projections is relatively large with respect to that of said grooves so as to constitute means for imparting abrupt polarity inversions to the columnar permanent magnet along the circumference of the latter.

2. An iron core assembly as claimed in claim 1, wherein said circumferential width of said magnetizable projection is 3.5 to 10 times that of said groove between said magnetizable projections.

3. An iron core assembly as claimed in claim 2, wherein said groove between said magnetizable projections is fully filled with said coil winding.

4. An iron core assembly as claimed in claim 2, wherein said core assembly is divided into a plurality of axially extending iron core segments along planes which pass the longitudinal axis of said through-bore.

* * * * *